US009677341B2

(12) United States Patent
Anderle et al.

(10) Patent No.: US 9,677,341 B2
(45) Date of Patent: Jun. 13, 2017

(54) DRILL BIT WITH EXTENDED LIFE SEAL

(75) Inventors: Seth G. Anderle, Spring, TX (US); Ping C. Sui, The Woodlands, TX (US); Mark E. Williams, The Woodlands, TX (US); Guy Lefort, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 548 days.

(21) Appl. No.: 13/381,591

(22) PCT Filed: Jul. 12, 2010

(86) PCT No.: PCT/US2010/041642

§ 371 (c)(1),
(2), (4) Date: Dec. 29, 2011

(87) PCT Pub. No.: WO2011/008661

PCT Pub. Date: Jan. 20, 2011

(65) Prior Publication Data

US 2012/0111639 A1 May 10, 2012

Related U.S. Application Data

(60) Provisional application No. 61/224,958, filed on Jul. 13, 2009.

(51) Int. Cl.
*E21B 10/25* (2006.01)

(52) U.S. Cl.
CPC ..... *E21B 10/25* (2013.01)

(58) Field of Classification Search
CPC ..... E21B 10/22; E21B 10/25; E21B 10/00; E21B 10/08; F16J 15/32; F16J 15/56; F16L 17/035; F16L 17/025
USPC ..... 175/371, 372; 277/336, 589, 616, 623, 277/24
See application file for complete search history.

(56) References Cited

U.S. PATENT DOCUMENTS 3,765,495 A 10/1973 Murdoch et al.
4,037,673 A 7/1977 Justman
4,554,985 A 11/1985 Backlund
(Continued)

OTHER PUBLICATIONS

International Search Report with Written Opinion issued Feb. 21, 2011 for PCT Patent Application No. PCT/US10/041642, 8 pages.
(Continued)

*Primary Examiner* — Wei Wang
(74) *Attorney, Agent, or Firm* — Baker Botts L.L.P.

(57) ABSTRACT

An extended life seal is incorporated into a drill bit used for drilling a wellbore. The drill bit can include a seal surface, a seal which engages the seal surface, and a groove which compresses the seal greater on opposite axial sides than at a central portion of the seal. The drill bit may include the seal having a cylindrical surface which engages the seal surface, and another cylindrical surface opposite the first surface, and the groove having a third cylindrical surface which engages the second surface, and wherein the groove simultaneously biases the seal toward the seal surface on opposite axial sides of the third surface. The drill bit may include the seal having right cylindrical shaped inner and outer surfaces, and a contact pressure between the seal surface and the seal being greater at each opposite side of the seal than at a central portion of the seal.

20 Claims, 5 Drawing Sheets

(56) References Cited

U.S. PATENT DOCUMENTS

| | | | | |
|---|---|---|---|---|
| 6,536,542 | B1 * | 3/2003 | Fang et al. | 175/371 |
| 6,598,690 | B2 | 7/2003 | Peterson | |
| 6,752,223 | B2 * | 6/2004 | Panigrahi et al. | 175/57 |
| 6,769,500 | B2 | 8/2004 | Miglierini | |
| 7,036,613 | B2 | 5/2006 | Burr | |
| 8,020,638 | B2 * | 9/2011 | Chellappa et al. | 175/371 |
| 2003/0029645 | A1 | 2/2003 | Mourik et al. | |
| 2006/0065445 | A1 | 3/2006 | Chellappa et al. | |
| 2010/0147595 | A1 * | 6/2010 | Zahradnik et al. | 175/371 |
| 2010/0193251 | A1 * | 8/2010 | Gallifet et al. | 175/371 |

OTHER PUBLICATIONS

International Preliminary Report on Patentability issued Jan. 26, 2012 for PCT Patent Application No. PCT/US10/041642, 5 pages.
Specification and Drawings filed Jul. 13, 2009 for U.S. Appl. No. 61/224,958, 29 pages.
Halliburton, "Parco Seal 1.4 to 1.0", drawing No. 505585, dated Feb. 15, 2006, 1 page.

* cited by examiner

DRILL BIT WITH EXTENDED LIFE SEAL

CROSS-REFERENCE TO RELATED APPLICATIONS

This application is a national stage under 35 USC 371 of International Application No. PCT/US2010/041642, filed on 12 Jul. 2010, which claims priority to U.S. Provisional Application No. 61/224,958, filed on 13 Jul. 2009. The entire disclosures of these prior applications are incorporated herein by this reference.

TECHNICAL FIELD

This disclosure relates generally to equipment utilized and operations performed in conjunction with a subterranean well and, in an example described below, more particularly provides a drill bit with an extended life seal.

BACKGROUND

Drill bits used to drill wellbores have to operate in an extremely hostile environment. As a result, such drill bits are highly specialized for their purpose. One such drill bit is of the type known as a roller cone bit, in which cutting elements are mounted on cones which rotate as the drill bit is rotated downhole to drill a wellbore.

To facilitate rotation of the cones, bearings are provided between the cones and a body of the bit, and lubricant is provided for the bearings. To prevent external debris from damaging the bearings or otherwise causing excessive wear in the rotating cones, and to prevent escape of the lubricant, seals are also provided in such bits.

Unfortunately, in the harsh downhole environment, seals in drill bits tend to fail (e.g., permit excessive wear, no longer exclude debris, fail to contain the lubricant, etc.) sooner than is desired. Drilling operations could be made much more economical and expeditious if drill bit seals had longer lives.

SUMMARY

In the disclosure below, a drill bit and seal configuration therefor are provided which bring improvements to the art of sealing in drill bits. One example is described below in which a drill bit seal has its greatest contact pressure areas most closely positioned adjacent cooling fluid. Another example is described below in which areas of highest friction between the seal and a seal surface are concentrated at opposite sides of the seal.

In one aspect, an improved drill bit for drilling a wellbore is provided by the present disclosure. The drill bit includes a seal surface, a seal which engages the seal surface, and a groove which compresses the seal greater on opposite axial sides of a central portion of the seal than at the central portion of the seal.

In another aspect, a drill bit for drilling a wellbore is provided which includes a seal surface, a seal having a first cylindrical surface which engages the seal surface, and a second cylindrical surface opposite the first surface. The seal is retained in a groove. The groove has a third cylindrical surface which engages the second surface of the seal. The groove simultaneously biases the seal toward the seal surface on opposite axial sides of the third surface.

In yet another aspect, a drill bit for drilling a wellbore is provided which includes a seal surface and a seal which engages the seal surface. The seal has right cylindrical shaped inner and outer diameter surfaces. A contact pressure between the seal surface and the seal is greater on opposite axial sides of a central portion of a contact area between the seal and the seal surface than at the central portion of the contact area.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
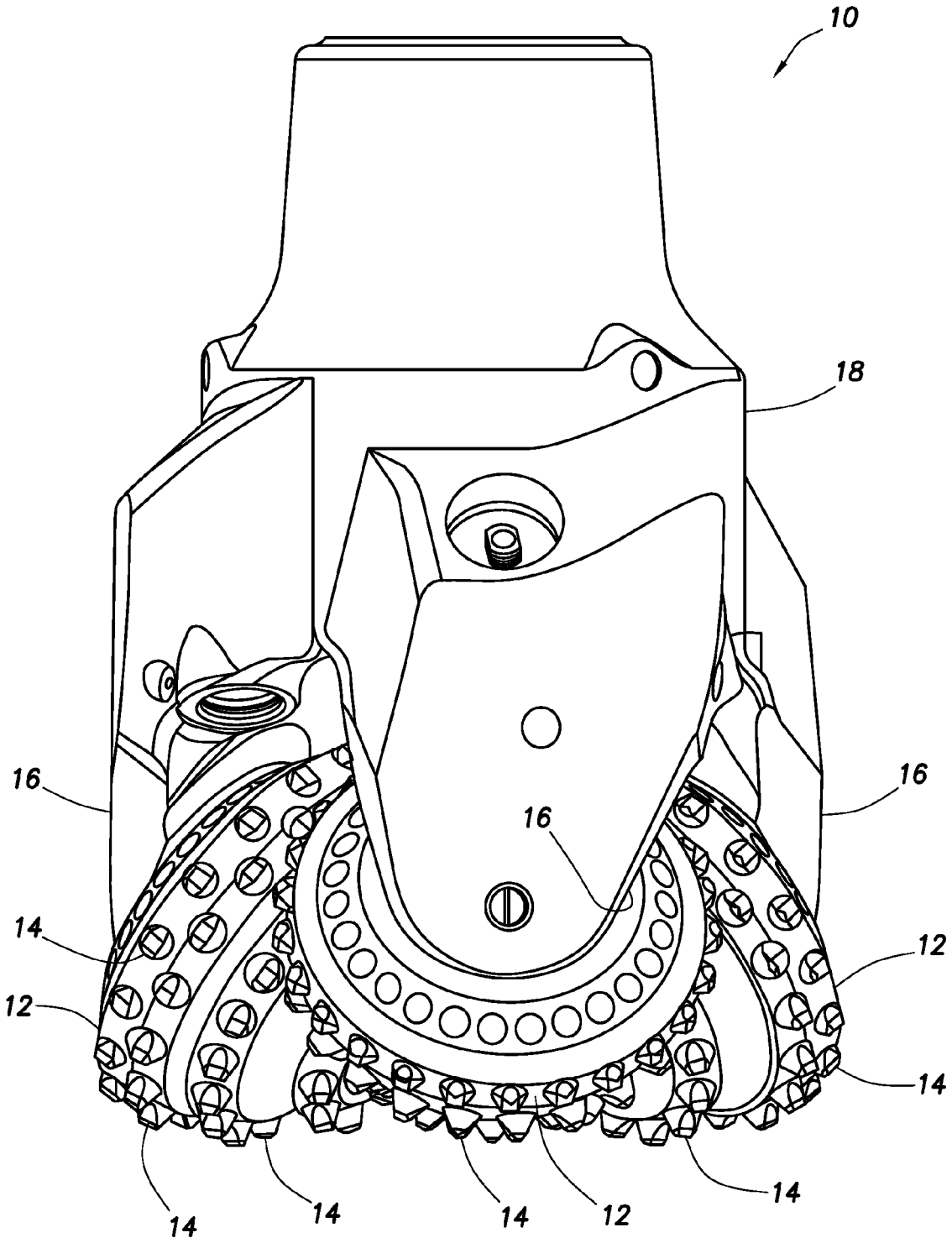
FIG. 1 is an elevational view of a drill bit embodying principles of the present disclosure.

Representatively illustrated in FIG. 1 is a drill bit 10 which embodies principles of this disclosure. The drill bit 10 is of the type known to those skilled in the art as a roller cone bit or a tri-cone bit, due to its use of multiple generally conical shaped rollers or cones 12 having earth-engaging cutting elements 14 thereon.

Each of the cones 12 is rotatably secured to a respective arm 16 extending downwardly (as depicted in FIG. 1) from a main body 18 of the bit 10. In this example, there are three each of the cones 12 and arms 16.

However, it should be clearly understood that the principles of this disclosure may be incorporated into drill bits having other numbers of cones and arms, and other types of drill bit configurations. The drill bit 10 depicted in FIG. 1 is merely one example of a wide variety of drill bits which can utilize the principles described herein.

Figure 2:
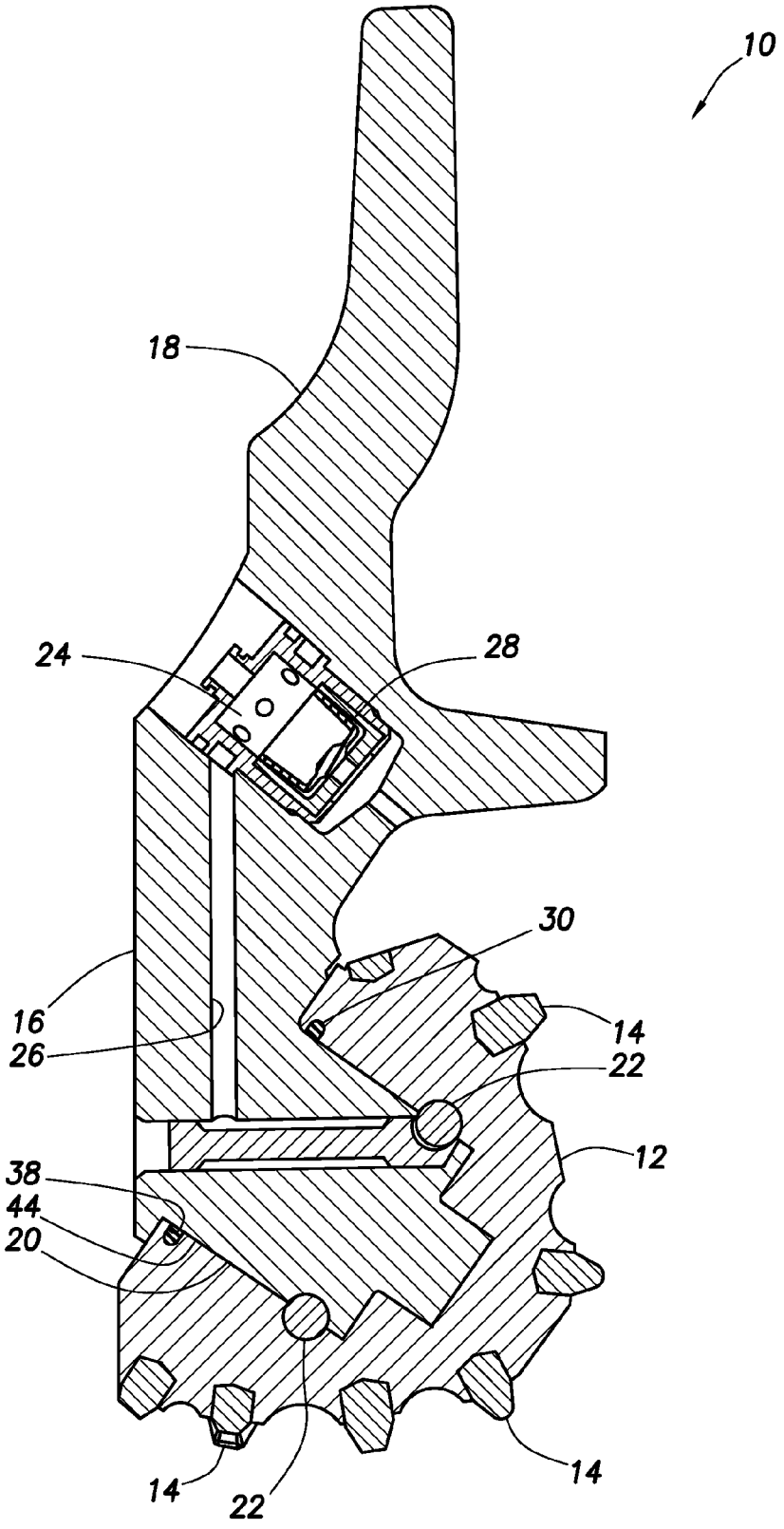
FIG. 2 is a cross-sectional view through one arm of the drill bit of FIG. 1.

Referring additionally now to FIG. 2, a cross-sectional view of one of the arms 16 is representatively illustrated. In this view it may be seen that the cone 12 rotates about a journal 20 of the arm 16. Bearings 22 are used between the cone 12 and the journal 20 to secure the cone on the arm.

Lubricant is supplied to the interface between the cone 12 and the journal 20 from a chamber 24 via a passage 26. A pressure equalizing device 28 ensures that the lubricant is at substantially the same pressure as the downhole environment when the drill bit 10 is being used to drill a wellbore.

A seal 30 is used to prevent debris and well fluids from entering the interface between the cone 12 and the journal 20, and to prevent escape of the lubricant from the interface area. As the cone 12 rotates about the journal 20, the seal 30 preferably rotates with the cone and seals against an outer surface of the journal, as described more fully below.

Figure 3:
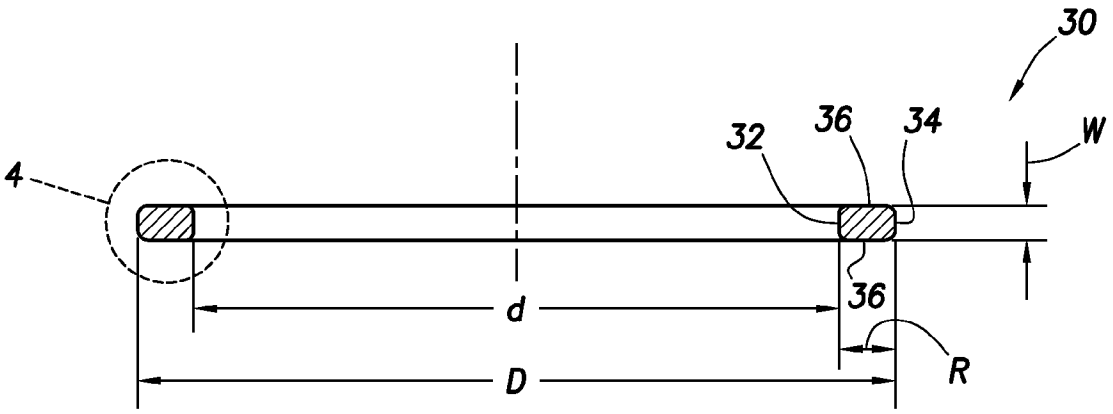
FIG. 3 is an enlarged scale cross-sectional view through a seal embodying principles of the present disclosure.

Referring additionally now to FIG. 3, an enlarged scale cross-sectional view of the seal 30 is representatively illustrated, apart from the remainder of the drill bit 10. In this view it may be seen that the seal 30 is generally annular shaped, with an inner diameter d, an outer diameter D, an axial width W, and a radial width R.

Figure 4:
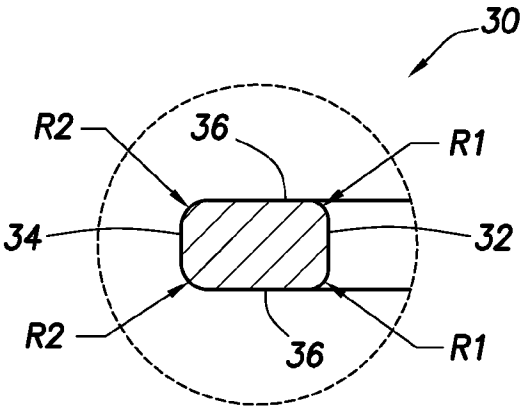
FIG. 4 is a further enlarged scale cross-sectional view through one side of the seal, as indicated by detail "4" in FIG. 3.

A further enlarged scale cross-sectional view of one side of the seal 30 is representatively illustrated in FIG. 4. In this view it may be seen that the seal 30 has radii R1 straddling an inner right cylindrical surface 32, and radii R2 straddling an outer right cylindrical surface 34.

The surfaces 32, 34 preferably have their right cylindrical shapes to provide stability to the seal 30 during use in the extremely harsh downhole environment. However, the surfaces 32, 34 could have some curvature, angularity or other non-cylindrical geometric shape, in keeping with the principles of this disclosure.

Note that the seal 30 is also preferably axially symmetrical, for example, its opposite axial sides 36 are substantially identical, the radii R1 are identical to each other, and the radii R2 are identical to each other. Thus, the seal 30 cannot easily be installed incorrectly.

Preferably, the radii R1 are greater than or equal to 0.1 times the axial width W of the seal 30, and less than or equal to 0.3 times the axial width. However, other dimensions for the radii R1, and other relative dimensions between the radii R1 and the axial width W, may be used if desired.

Preferably, the radii R2 are greater than or equal to 1.4 times the radii R1, and less than or equal to 2 times the radii R1. However, other dimensions for the radii R2, and other relative dimensions between the radii R1 & R2, may be used if desired.

The preferred dimensions described above are expected to produce beneficial results for the seal 30 as used in the drill bit 10. When used in other types of drill bits, however, the optimum dimensions could be different, so the dimensions should be evaluated for each specific application.

Figure 5:
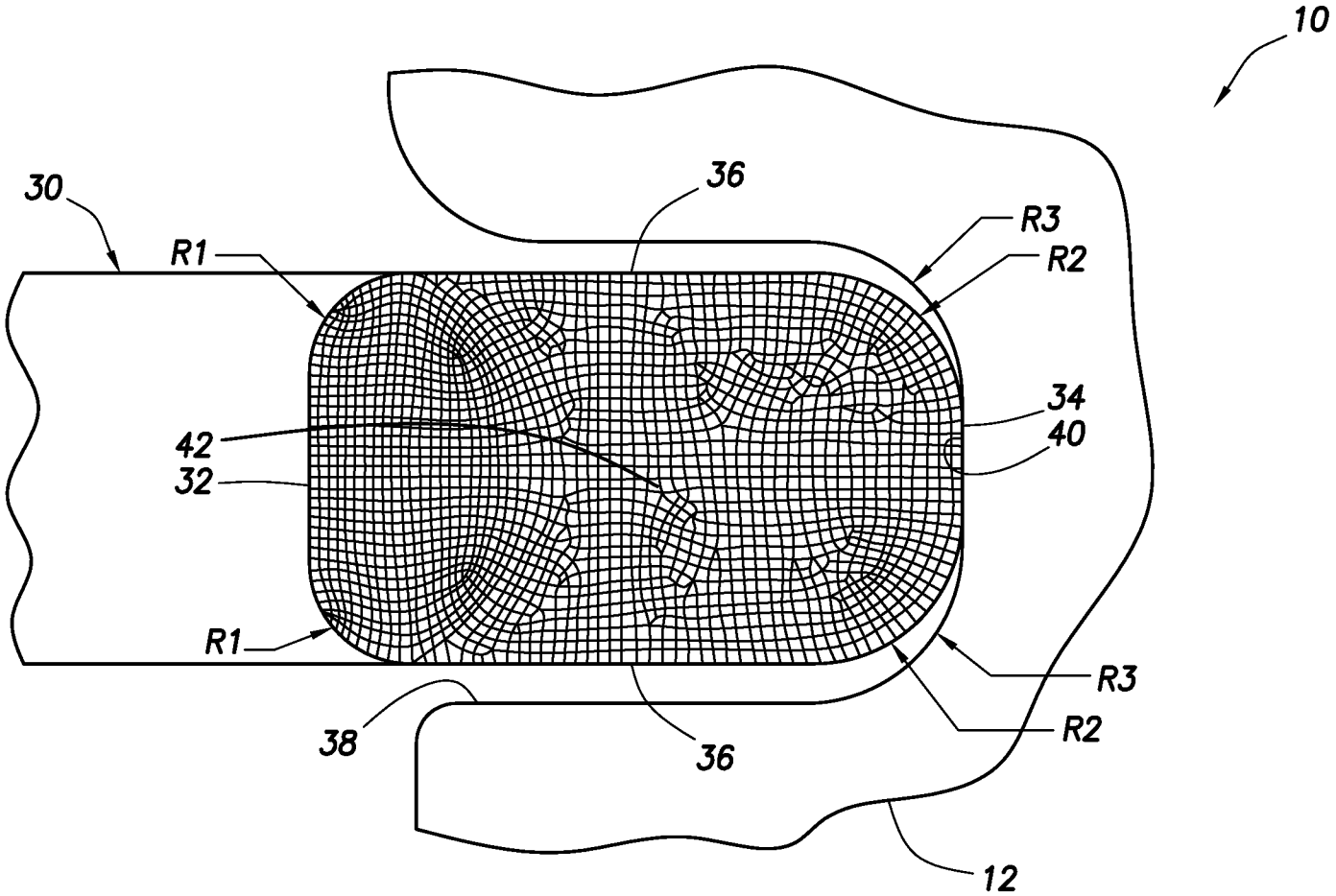
FIG. 5 is a still further enlarged scale cross-sectional view of the seal as installed in a circumferential groove formed in a roller cone of the drill bit.

Referring additionally now to FIG. 5, the seal 30 is representatively illustrated after having been installed in a circumferential groove 38 formed in the cone 12. The groove 38 in this example performs more functions than just retaining the seal 30 and providing a seal surface against which the seal seals. The groove 38 also cooperates with the seal 30 to produce a unique profile of contact pressure between the seal and the journal 20.

As depicted in FIG. 5, the groove 38 has radii R3 straddling an outer cylindrical surface 40. The groove surface 40 contacts the outer surface 34 of the seal 30.

Note that the radii R3 are preferably greater than the radii R2 on the seal 30. In other examples, the radii R3 could be equal to the radii R2, but preferably the radii R3 are not less than the radii R2.

It will be appreciated that, when the seal 30 is radially compressed in the groove 38, the radii R3 will engage the seal (at the radii R2), with the result that the seal will be compressed more near its opposite sides 36 than in a central portion 42 of the seal. This will also cause a greater contact pressure between the seal 30 and the journal 20 near the opposite sides 36 of the seal, as compared to at the central portion 42 of the seal.

Figure 6:
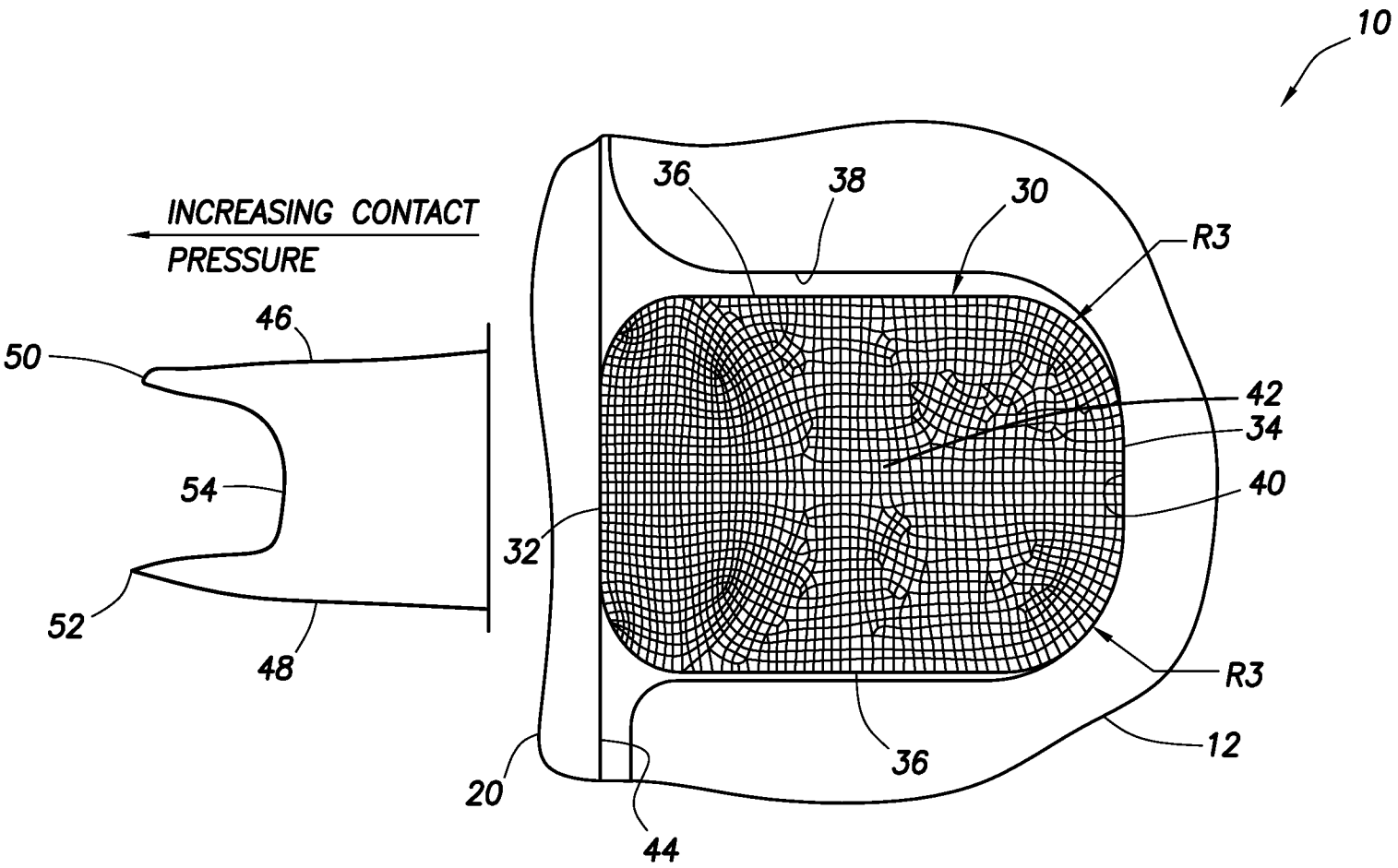
FIG. 6 is a cross-sectional view of the seal as installed in the assembled drill bit, the seal engaging a seal surface on the arm of the drill bit, and a profile being shown of contact pressure applied between the seal and the seal surface.

Referring additionally now to FIG. 6, the seal 30 is representatively illustrated after the cone 12 (with the seal in the groove 38 therein) has been installed on the journal 20. The seal 30 now sealingly engages a cylindrical seal surface 44 on the journal 20, and the seal is radially compressed between the seal surface and the outer surface 40 of the groove 38.

The radii R3 of the groove 38 compress the seal 30 near its outer sides 36 to a greater extent than the seal is compressed at its central portion 42. Thus, contact pressure between the seal 30 and the seal surface 44 is greater on opposite sides of a central portion of the contact area between the seal and the seal surface, as compared to at the central portion of the contact area.

Although the radii R3 are described above as a feature of the groove 38 which increases compression of the seal 30 on opposite axial sides of its central portion 42, other features could be used instead of, or in addition to, the radii R3. For example, the groove 38 could have chamfers or other types of features on opposite sides of the surface 40 for increasing compression of the seal 30, the surface 40 itself could be contoured in a manner which increases compression of the seal on opposite sides of its central portion 42, etc.

Preferably, the axial length of the surface 34 between the radii R2 on the seal 30 is greater than the axial length of the surface 40 between the radii R3 of the groove 38, so that the radii R3 initially contact the seal when it is installed in the groove, in order to enhance the compression of the seal on opposite sides of its central portion 42. However, this relationship between the axial lengths of the surfaces 34, 40 is not necessary in keeping with the principles of this disclosure.

The compressive biasing forces applied to the seal 30 by the radii R3 of the groove are responsible for the increased compression of the seal on opposite axial sides of the central portion 42. This increased compression results in the increased contact pressure depicted in the graph in FIG. 6.

Note that the contact pressure increases very rapidly (at 46 and 48 in the graph) at the opposite edges of the contact area between the seal 30 and the seal surface 44. This large contact pressure slope enables maximum contact pressure (at 50 and 52 in the graph) to be achieved very near the opposite edges of the contact area.

One benefit of the maximum contact pressure 50, 52 being near the opposite edges of the contact area is that this helps to exclude debris (such as sand, etc.) and fluid from getting under the seal 30, or between the seal and the seal surface 44. Another benefit is that, since higher contact pressure results in greater friction and heat production, the greatest friction is in an area of the seal 30 which is most directly exposed to fluids (lubricant on one side, and drilling fluid on the other side) which will operate to provide cooling for the seal.

By excluding debris and cooling the seal 30 at its areas of maximum contact pressure against the seal surface 44, the service life of the seal is substantially increased. This can also result in decreased wear of the seal surface 44.

Preferably, the minimum contact pressure (at 54 in the graph) between the maximum contact pressures 50, 52 near the opposite edges of the contact area is between approximately 20 and 80% of the maximum contact pressures. Most preferably, the minimum contact pressure 54 is less than 60% of the greatest of the maximum contact pressures 50, 52. However, other relative contact pressure relationships may be used, if desired.

Another benefit of the seal 30 and groove 38 configuration described above is that the contact pressure profile is substantially symmetrical axially. This helps to stabilize the seal 30 in use (e.g., when the seal is rotating about the journal 20).

Yet another benefit of the seal 30 and groove 38 configuration is that the other benefits remain, even as the seal wears in use. Thus, although the opposite edges of the contact area between the seal 30 and the seal surface 44 may get closer to each other as the seal wears away due to friction, the contact pressure near the opposite edges of contact is still greater than contact pressure in the middle of the contact area.

One reason for this is that the seal surface 32 which contacts the seal surface 44 is right cylindrical shaped, instead of having bumps, ridges, etc. formed thereon to produce the increased contact pressure. Seals which produce increased contact pressure due to such bumps, ridges, etc. on the seals lose the ability to do so once the bumps, ridges, etc. are worn away.

In contrast, the seal 30 and groove 38 produce the increased contact pressure between the seal and the seal surface 44 due to the groove compressing the seal more near its opposite sides 36 than at its central portion 42. As a result, this increased contact pressure remains, even though the seal may experience wear during use.

Another reason for the contact pressure near the opposite edges of contact remaining greater than contact pressure in the middle of the contact area, even though the seal 30 may wear in use, is that the seal is preferably made of a single material, rather than relying on different materials to produce respective different contact pressures or other sealing characteristics in the contact area. Seals which do rely on such different materials to produce enhanced sealing characteristics lose the ability to do so if the different materials wear away during use. However, it should be understood that the seal 30 could utilize more than one material, in keeping with the principles of this disclosure.

The seal 30 is preferably made of a material such as HNBR, in which case the maximum contact pressures 50, 52, as assembled, may be approximately 200-450 psi (~1380-3105 kpa), and the material may have a hardness of approximately 80±5 durometer. However, other materials (such as NBR, FKM, fluorocarbon elastomers, etc.), other maximum contact pressures and other material hardnesses may be used in keeping with the principles of this disclosure.

Preferably, the surfaces 32, 34 of the seal 30 are right cylindrical shaped. The surfaces 40, 44 of the groove 38 and journal 20, respectively, are also preferably right cylindrical shaped. However, other shapes may be used for these surfaces, if desired.

A further benefit of the seal 30 and groove 38 configuration described above is that the seal should not wear appreciably between the areas of greatest contact pressure 50, 52. This is due to the fact that substantially less contact pressure (e.g., at 54 in the FIG. 6 graph) is experienced between the maximum contact pressures 50, 52, and so less friction and wear is also experienced in this area.

It may now be fully appreciated that the above disclosure provides many advancements to the art of sealing in drill bits used for drilling wellbores. The seal 30 described above should have longer life and greater effectiveness, leading to reduced expenditures of time and money in drilling operations.

The above disclosure in particular describes a drill bit 10 for drilling a wellbore. The drill bit 10 includes a seal surface 44, a seal 30 which engages the seal surface 44, and a groove 38 which compresses the seal 30 greater on opposite axial sides of a central portion 42 of the seal 30 than at the central portion 42 of the seal 30.

A contact pressure between the seal surface 44 and the seal 30 may be greater on opposite axial sides of a central portion of a contact area between the seal 30 and the seal surface 44 than at the central portion of the contact area. Minimum contact pressure 54 between the seal surface 44 and the seal 30 at the central portion of the contact area may be approximately 20-80% of a maximum contact pressure 50 or 52 between the seal surface 44 and the seal 30 on the opposite sides of the central portion of the contact area. Minimum contact pressure 54 between the seal surface 44 and the seal 30 at the central portion of the contact area may be less than 60% of a maximum contact pressure 50 or 52 between the seal surface 44 and the seal 30 on the opposite sides of the central portion of the contact area.

The seal 30 may engage the seal surface 44 at a first surface 32 of the seal 30, and the seal 30 may further have first radii R1 straddling the first surface 32. The first surface 32 may have a right cylindrical shape.

The seal 30 may engage the groove 38 at a second surface 34 of the seal 30, and the seal 30 may further have second radii R2 straddling the second surface 34. The second surface 34 may have a right cylindrical shape.

The groove 38 may engage the seal 30 at a third surface 40 of the groove 38, with the groove 38 further having third radii R3 straddling the third surface 40. The third radii R3 are preferably greater than or equal to the second radii R2.

The second radii R2 may be greater than or equal to 1.4 times the first radii R1, and the second radii R2 may be less than or equal to 2 times the first radii R1. The first radii R1 may be greater than or equal to 0.1 times an axial width W of the seal 30, and the first radii R1 may be less than or equal to 0.3 times the axial width W of the seal 30.

An axial width of the third surface 40 between the third radii R3 may be less than an axial width of the second surface 34 between the second radii R2 prior to engagement of the seal 30 with the seal surface 44.

Also described by the above disclosure is a drill bit 10 for drilling a wellbore, with the drill bit 10 including a seal surface 44, a seal 30 having a first cylindrical surface 32 which engages the seal surface 44, and a second cylindrical surface 34 opposite the first surface 32, and a groove 38 in which the seal 30 is retained. The groove 38 has a third cylindrical surface 40 which engages the second surface 34 of the seal 30. The groove 38 simultaneously biases the seal 30 toward the seal surface 44 on opposite axial sides of the third surface 40.

Radii R3 at the opposite axial sides of the third surface 40 may simultaneously contact and compress the seal 30 on opposite axial sides of a central portion 42 of the seal 30.

The first surface 32 may have a right cylindrical shape prior to engagement with the seal surface 44. The seal 30 may be made of only a single material. Opposite axial sides of the seal 30 may be symmetrically shaped relative to each other.

The above disclosure also describes a drill bit 10 for drilling a wellbore, in which the drill bit 10 includes a seal surface 44 and a seal 30 which engages the seal surface 44. The seal 30 has right cylindrical shaped inner and outer diameter surfaces 32, 34. A contact pressure between the seal surface 44 and the seal 30 is greater on opposite axial sides of a central portion of a contact area between the seal 30 and the seal surface 44 than at the central portion of the contact area.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of sealing a drill bit for drilling a wellbore, the method comprising:

dynamically engaging a seal with a seal surface on a journal to form a contact area between the seal and the seal surface;

placing the seal in a groove on a cone to form a static seal with the cone and such that multiple features of the groove simultaneously radially compress the seal greater on opposite axial sides of a central portion of the seal than at the central portion of the seal to create a contact pressure at a central portion of the contact area that is between 20% and 80% of a maximum contact pressure between the seal surface and the seal on opposite sides of the central portion of the contact area.

2. The method of claim 1, wherein a first substantially cylindrical surface of the seal engages the seal surface, a second substantially cylindrical surface of the seal, opposite the first substantially cylindrical surface, engages a third substantially cylindrical surface of the groove to from the static seal.

3. The method of claim 2, wherein the multiple features of the groove comprise multiple features on opposite axial sides of the third substantially cylindrical surface which simultaneously radially bias the seal toward the seal surface on opposite axial sides of the seal to create the contact pressure.

4. The method of claim 2, wherein first radii straddle the first substantially cylindrical surface, second radii straddle the second substantially cylindrical surface, and third radii straddle the third substantially cylindrical surface, and the third radii are greater than or equal to the second radii to create the static seal or contact pressure, or both.

5. The method of claim 2, wherein first radii straddle the first substantially cylindrical surface, second radii straddle the second substantially cylindrical surface, and third radii straddle the third substantially cylindrical surface, and the second radii are greater than or equal to 1.4 times the first radii, and wherein the second radii are less than or equal to 2 times the first radii to create the static seal or contact pressure, or both.

6. The method of claim 2, wherein first radii straddle the first substantially cylindrical surface, second radii straddle the second substantially cylindrical surface, and third radii straddle the third substantially cylindrical surface, and the first radii are less than or equal to 0.3 times the axial width of the seal to create the static seal or contact pressure, or both.

7. The method of claim 2, wherein first radii straddle the first substantially cylindrical surface, second radii straddle the second substantially cylindrical surface, and third radii straddle the third substantially cylindrical surface, and an axial width of the third cylindrical surface between the third radii is less than an axial width of the second cylindrical surface between the second radii prior to engaging the seal with the seal surface, further comprising altering the axial width of the second cylindrical surface by engaging the seal with the seal surface.

8. The method of claim 2, wherein first radii straddle the first substantially cylindrical surface, second radii straddle the second substantially cylindrical surface, and third radii straddle the third substantially cylindrical surface, and the third radii at the opposite axial sides of the third substantially cylindrical surface simultaneously contact and compress the seal on opposite axial sides of the central portion of the seal.

9. The method of claim 2, wherein the first substantially cylindrical surface has a right cylindrical shape prior to engaging the seal with the seal surface.

10. The method of claim 2, wherein opposite axial sides of the seal are symmetrically shaped relative to each other to create a symmetrical static seal or a symmetrical contact pressure, or both.

11. The method of claim 1, wherein the contact pressure at the central portion of the contact area is less than 60% of the maximum contact pressure between the seal surface and the seal on opposite sides of the central portion of the contact area.

12. A method of drilling a wellbore, the method comprising:

rotating a cone of a drill bit around a journal of the drill bit while simultaneously dynamically engaging a seal with a seal surface on the journal to form a contact area between the seal and the seal surface and forming a static seal between the seal and a groove in the cone, such that multiple features of the groove simultaneously radially compress the seal greater on opposite axial sides of a central portion of the seal than at the central portion of the seal to create a contact pressure at a central portion of the contact area that is between 20% and 80% of a maximum contact pressure between the seal surface and the seal on opposite sides of the central portion of the contact area.

13. The method of claim 12, wherein a first substantially cylindrical surface of the seal engages the seal surface, a second substantially cylindrical surface of the seal, opposite the first substantially cylindrical surface, engages a third substantially cylindrical surface of the groove to from the static seal.

14. The method of claim 13, wherein the multiple features of the groove comprise multiple features on opposite axial sides of the third substantially cylindrical surface which simultaneously radially bias the seal toward the seal surface on opposite axial sides of the seal to create the contact pressure.

15. The method of claim 13, wherein first radii straddle the first substantially cylindrical surface, second radii straddle the second substantially cylindrical surface, and third radii straddle the third substantially cylindrical surface, and the third radii are greater than or equal to the second radii to form the static seal, create the contact pressure, or both.

16. The method of claim 13, wherein first radii straddle the first substantially cylindrical surface, second radii straddle the second substantially cylindrical surface, and third radii straddle the third substantially cylindrical surface, and the second radii are greater than or equal to 1.4 times the first radii, and wherein the second radii are less than or equal to 2 times the first radii to form the static seal, create the contact pressure, or both.

17. The method of claim 13, wherein first radii straddle the first substantially cylindrical surface, second radii straddle the second substantially cylindrical surface, and third radii straddle the third substantially cylindrical surface, and the first radii are less than or equal to 0.3 times the axial width of the seal to form the static seal, create the contact pressure, or both.

18. The method of claim 13, wherein first radii straddle the first substantially cylindrical surface, second radii straddle the second substantially cylindrical surface, and third radii straddle the third substantially cylindrical surface, and the third radii at the opposite axial sides of the third substantially cylindrical surface simultaneously contact and compress the seal on opposite axial sides of the central portion of the seal.

19. The method of claim 13, wherein opposite axial sides of the seal are symmetrically shaped relative to each other to form a symmetric static seal, create a symmetric contact pressure, or both.

20. The method of claim 12, wherein the contact pressure at the central portion of the contact area is less than 60% of the maximum contact pressure between the seal surface and the seal on opposite sides of the central portion of the contact area.

* * * * *